US007204678B2

(12) United States Patent
Truyens et al.

(10) Patent No.: US 7,204,678 B2
(45) Date of Patent: Apr. 17, 2007

(54) METHOD FOR CONTROLLING THE OIL RECIRCULATION IN AN OIL-INJECTED SCREW-TYPE COMPRESSOR AND COMPRESSOR USING THIS METHOD

(75) Inventors: Francois Louis Josephine Truyens, Bornem (BE); Ivan Alice Daniël Noukens, Wilrijk (BE)

(73) Assignee: Atlas Copco Airpower, naamloze vennootschap, Wilrijk (BE)

( * ) Notice: Subject to any disclaimer, the term of this patent is extended or adjusted under 35 U.S.C. 154(b) by 455 days.

(21) Appl. No.: 10/500,136

(22) PCT Filed: Jan. 30, 2003

(86) PCT No.: PCT/BE03/00013

§ 371 (c)(1),
(2), (4) Date: Jul. 8, 2004

(87) PCT Pub. No.: WO03/067092

PCT Pub. Date: Aug. 14, 2003

(65) Prior Publication Data

US 2005/0089432 A1 Apr. 28, 2005

(30) Foreign Application Priority Data

Feb. 8, 2002 (BE) ..... 2002/0077

(51) Int. Cl.
*F04B 39/04* (2006.01)

(52) U.S. Cl. ..... 417/228; 418/84

(58) Field of Classification Search ..... 417/228, 417/312, 313, 410.1, 372; 418/84, 85, 87, 418/1, 201.1, 180; 184/6.16; 236/34.5
See application file for complete search history.

(56) References Cited

U.S. PATENT DOCUMENTS

| | | | | |
|---|---|---|---|---|
| 4,431,390 | A | 2/1984 | Hart | |
| 4,456,167 | A * | 6/1984 | Buter | 236/34.5 |
| 5,318,151 | A | 6/1994 | Hood et al. | |
| 5,761,914 | A | 6/1998 | Carey et al. | |
| 6,139,280 | A * | 10/2000 | Holt et al. | 417/26 |

FOREIGN PATENT DOCUMENTS

| | | |
|---|---|---|
| DE | 25 00 046 | 7/1976 |
| EP | 1 087 185 | 3/2001 |
| JP | 1-216093 | 8/1989 |

* cited by examiner

*Primary Examiner*—Ehud Gartenberg
*Assistant Examiner*—Vikansha Dwivedi
(74) *Attorney, Agent, or Firm*—Bacon & Thomas, PLLC

(57) ABSTRACT

The invention relates to a method for controlling the oil recirculation in an oil-injected screw-type compressor which, between the oil separator (10) and the compressor element (1), comprises an oil recirculation conduit (17) in which an oil cooler (18) is installed which is bridged-over by a passage or bypass (30), said control taking place by means of a thermostatic valve (24) having a valve element (26) which can be moved by means of a temperature-sensitive element (34). During the transition of the screw compressor from the unloaded to the loaded condition, the effect of the temperature-sensitive element (34) temporarily is switched off at least partially, such that the valve element (26) takes a position in which, regardless of the temperature of the oil, at least the bypass (30) is open and thus the recirculation of oil from the oil separator (10) to the compressor element (1) takes place through this bypass (30).

17 Claims, 7 Drawing Sheets

Figure 1:
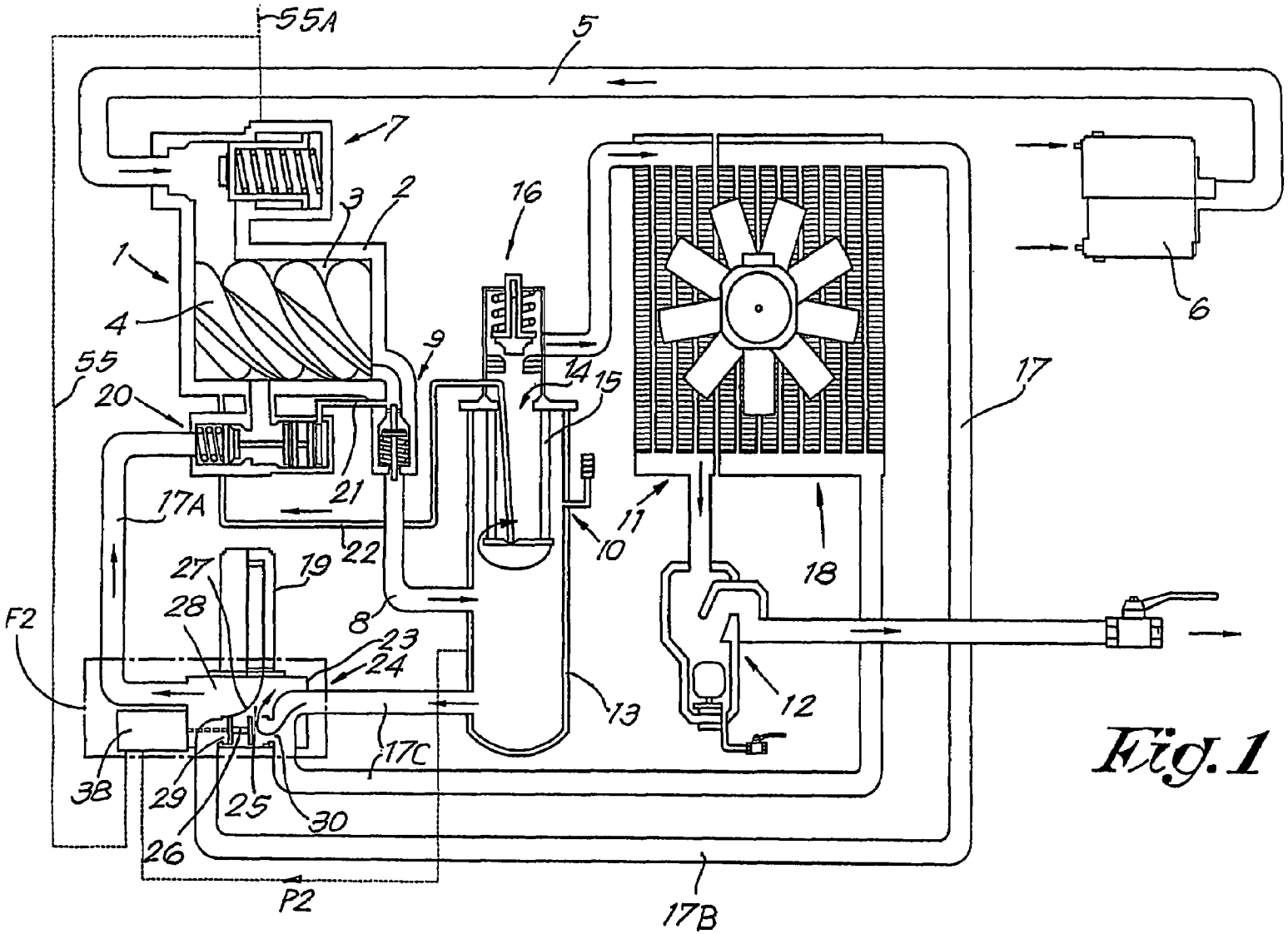

METHOD FOR CONTROLLING THE OIL RECIRCULATION IN AN OIL-INJECTED SCREW-TYPE COMPRESSOR AND COMPRESSOR USING THIS METHOD

This invention relates to a method for controlling the oil recirculation in an oil-injected screw-type compressor comprising a compressor element, connected thereto an inlet conduit and a pressure conduit, an oil separator in said pressure conduit, an oil recirculation conduit between said oil separator and the compressor element, in which recirculation conduit an oil cooler is installed, and a bypass bridging-over the oil cooler in the recirculation conduit, which controlling is performed by means of a thermostatic valve having a valve element which can be moved by means of a temperature-sensitive element, whereby the temperature-sensitive element measures the temperature of the recirculating oil and the valve element, if this temperature is below a certain value, opens the bypass, such that the separated oil from the oil separator can flow directly towards the compressor element without having to flow over the oil cooler and, if the temperature of the oil is above a certain value, which is higher than or equal to the aforementioned value, the valve element closes off the bypass.

According to the known methods, the valve element of the thermostatic valve is in that position in which it opens the bypass, when the oil is cold, and this when the compressor is without load as well as when the compressor changes from the unloaded to the loaded status.

When the oil is warmer than a well-defined temperature, then the valve element is in that position in which it closes the bypass, as a consequence of which the oil from the oil separator is forced to flow over the oil cooler before being injected back into the compressor element.

When the compressor is running without load and thus no air is suctioned into the compressor element, the pressure in the oil separator, which latter also serves as a pressure vessel, is kept as low as possible in order to limit the unloaded power consumption.

When transiting into the loaded working condition, and thus when opening the inlet valve, the screw-type compressor element maximally suctions air which then is compressed. Due to the low pressure in the oil separator, the oil pressure at the beginning of the transition also is low.

When the oil temperature is high, the bypass thus is closed, such that the oil flows over the oil cooler, which moreover causes a pressure drop, such that the oil injection pressure temporarily is particularly low.

As a consequence, with these known methods high temperature peaks may be created at the outlet of the compressor element.

The pressure in the oil separator during the unloaded operation of the compressor element and, thus, the consumed input, can not be chosen optimally low in order to prevent the occurrence of said temperature peaks.

The invention aims at a method for controlling the recirculation of the oil, whereby the pressure in the oil separator, when the compressor element is working without load, can be kept lower, without the risk of temperature peaks at the outlet of this compressor element during the transition from unloaded to loaded operation.

According to the invention, to this aim, during the transition from the unloaded to the loaded condition of the screw-type compressor, the influence of the temperature-sensitive element temporarily is switched off at least partially, such that the valve element temporarily takes a position in which, regardless of the temperature of the oil, at least the bypass is open and thus the recirculation of oil from the oil separator towards the compressor element temporarily takes place at least by means of this bypass.

Thus, the additional pressure drop in the oil cooler temporarily is switched off, such that, notwithstanding the low pressure of the oil, there still is a sufficient injection pressure in order to avoid temperature peaks at the outlet of the compressor element.

This switching-off of the influence of the temperature-sensitive element is solely of a short duration, in consideration of the fact that, under load, the pressure in the oil separator rapidly increases.

When transiting from unloaded to loaded, the valve element preferably takes a position whereby the bypass as well as the recirculation conduit are open, such that the oil temporarily can flow back to the compressor element through the bypass as well as through the oil cooler, regardless of the temperature of the oil.

The temporarily, at least partially, switching-off the effect of the temperature-sensitive element can take place by realizing a part of the wall of the thermostatic valve, against which the temperature-sensitive element normally is situated, as a piston of a pneumatically controllable piston mechanism, whereby the temperature-sensitive element can expand without moving the valve element, for example, by pushing away this piston, and whereby, for example, the pressure in the oil separator and the control pressure for operating a controlled inlet valve in the inlet conduit are used as control pressures.

The invention also relates to an oil-injected screw-type compressor which is suitable for being controlled according to the method described in the aforegoing.

Thus, the invention also relates to an oil-injected screw-type compressor comprising a screw-type compressor element, connected thereto an inlet conduit and a pressure conduit, an oil separator in said pressure conduit, an oil recirculation conduit between said oil separator and the compressor element, in which recirculation conduit an oil cooler is arranged, and a bypass bridging-over the oil cooler in the recirculation conduit and which can-be closed off by means of a valve element of a thermostatic valve with a valve element that can be moved by a temperature-sensitive element situated in the recirculation conduit, and with as a characteristic that the screw-type compressor comprises a control system which, when transiting from the unloaded to the loaded condition, temporarily switches off the effect of the temperature-sensitive element, onto the valve element of the thermostatic valve at least partially, such that during this transition, the valve element is in a position whereby at least the bypass is open, regardless of the temperature of the oil.

The bypass can be limited to a passage between a part of the recirculation conduit situated between the oil separator and the oil cooler, and a part of the recirculation conduit situated between the oil cooler and the compressor element.

In a particular form of embodiment of the invention, the valve element of the thermostatic valve is situated in the bypass as well as in the recirculation conduit upstream from the bypass, such that, in one position, it simultaneously opens the bypass and closes off the part of the recirculation conduit situated between the outlet of the oil cooler and the bypass, in another position simultaneously closes off the bypass and further opens the aforementioned part of the recirculation conduit, and preferably in the first-mentioned position and/or in an intermediate position opens the bypass as well as opens the aforementioned part of the recirculation conduit.

The valve element takes up the first-mentioned position, amongst others, when, during the transition from the unloaded to the loaded condition, the working of the thermostatic valve is switched off at least partially.

The aforementioned control system may comprise a piston mechanism, the piston of which, in a well-defined position, forms a stop for the temperature-sensitive element. When this piston is freely movable, then the temperature-sensitive element of the thermostatic valve can freely change its length, and the effect of this thermostatic valve thus is switched off at least partially.

Figure 2:
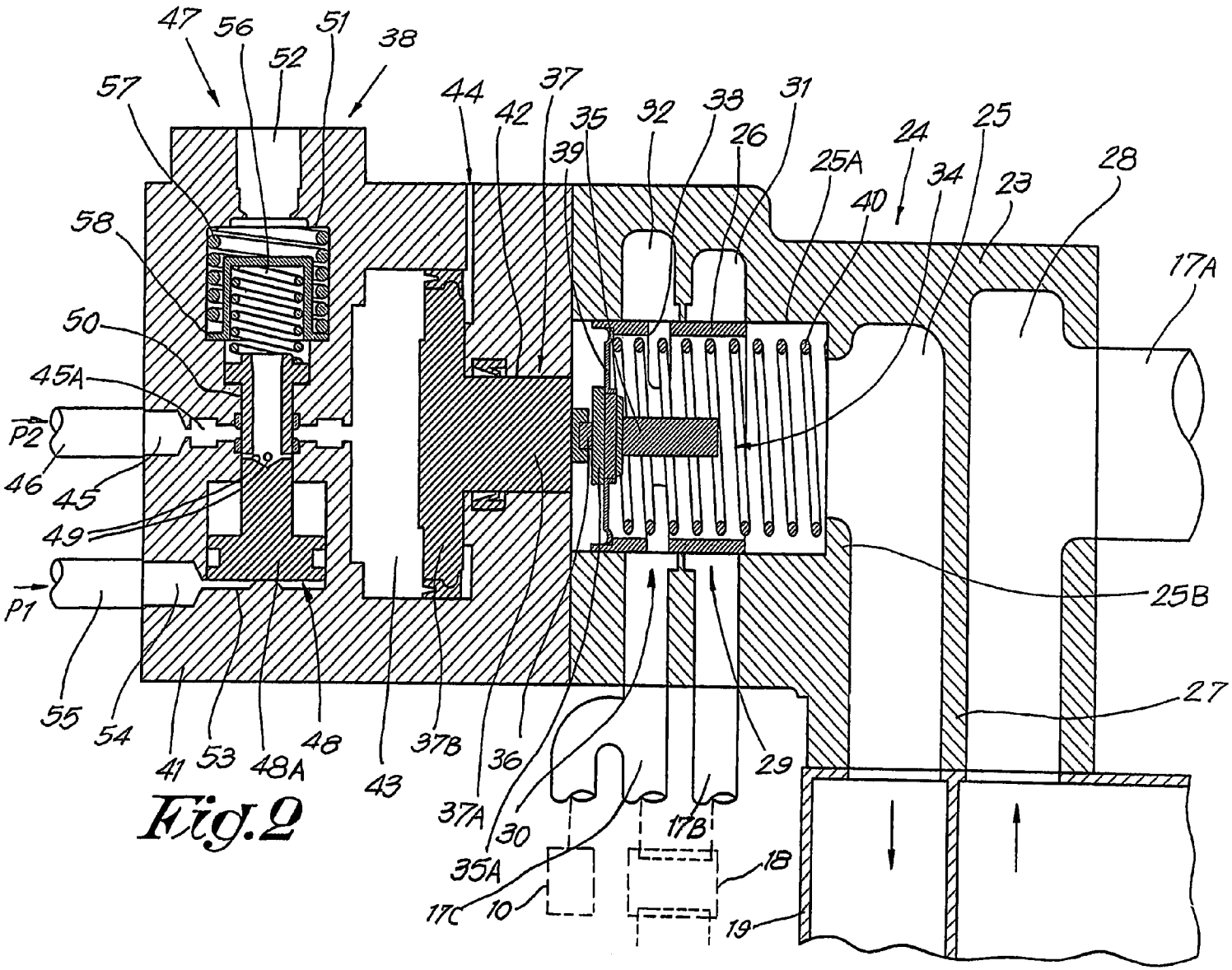
Figure 3:
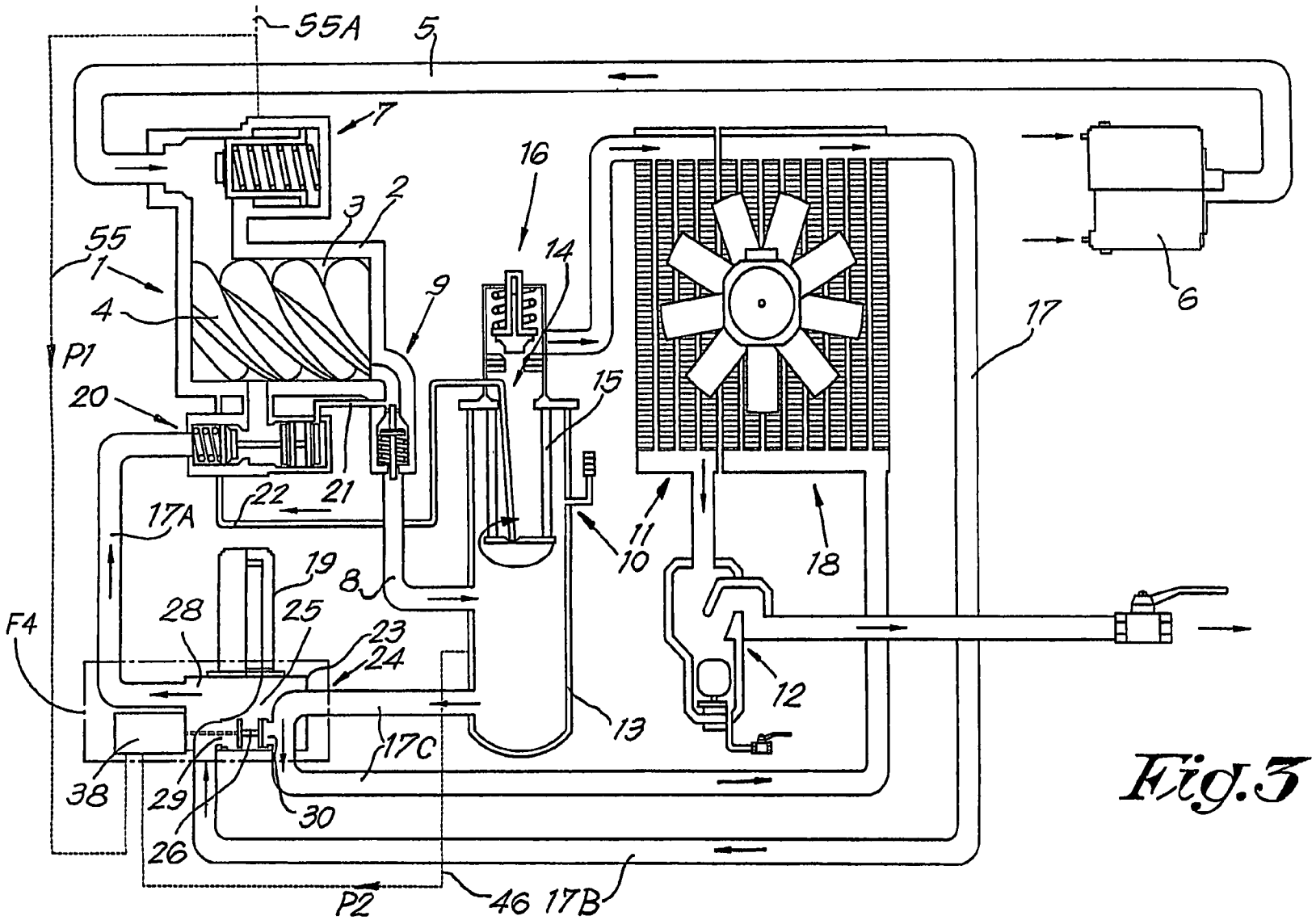
Figure 4:
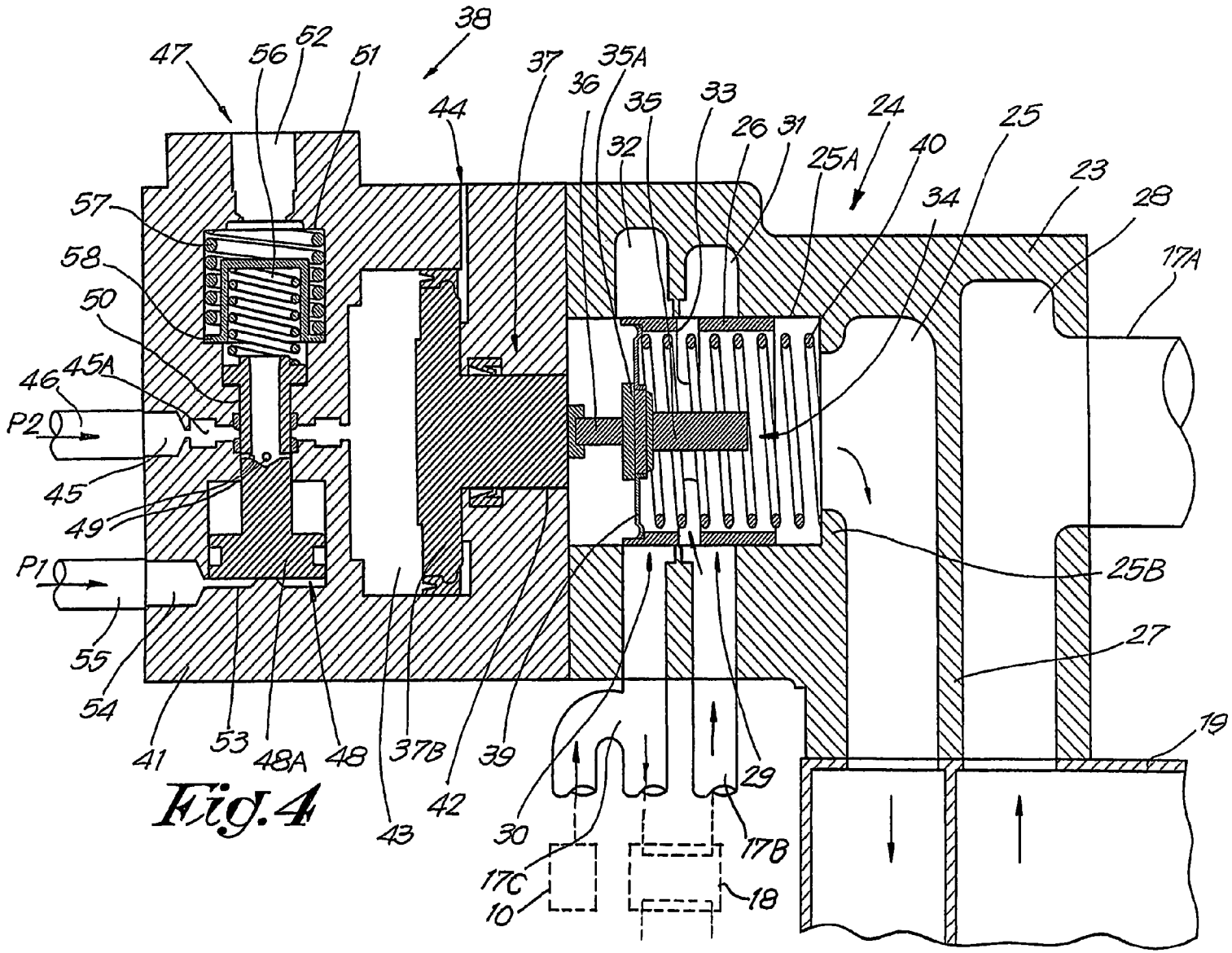
Figure 5:
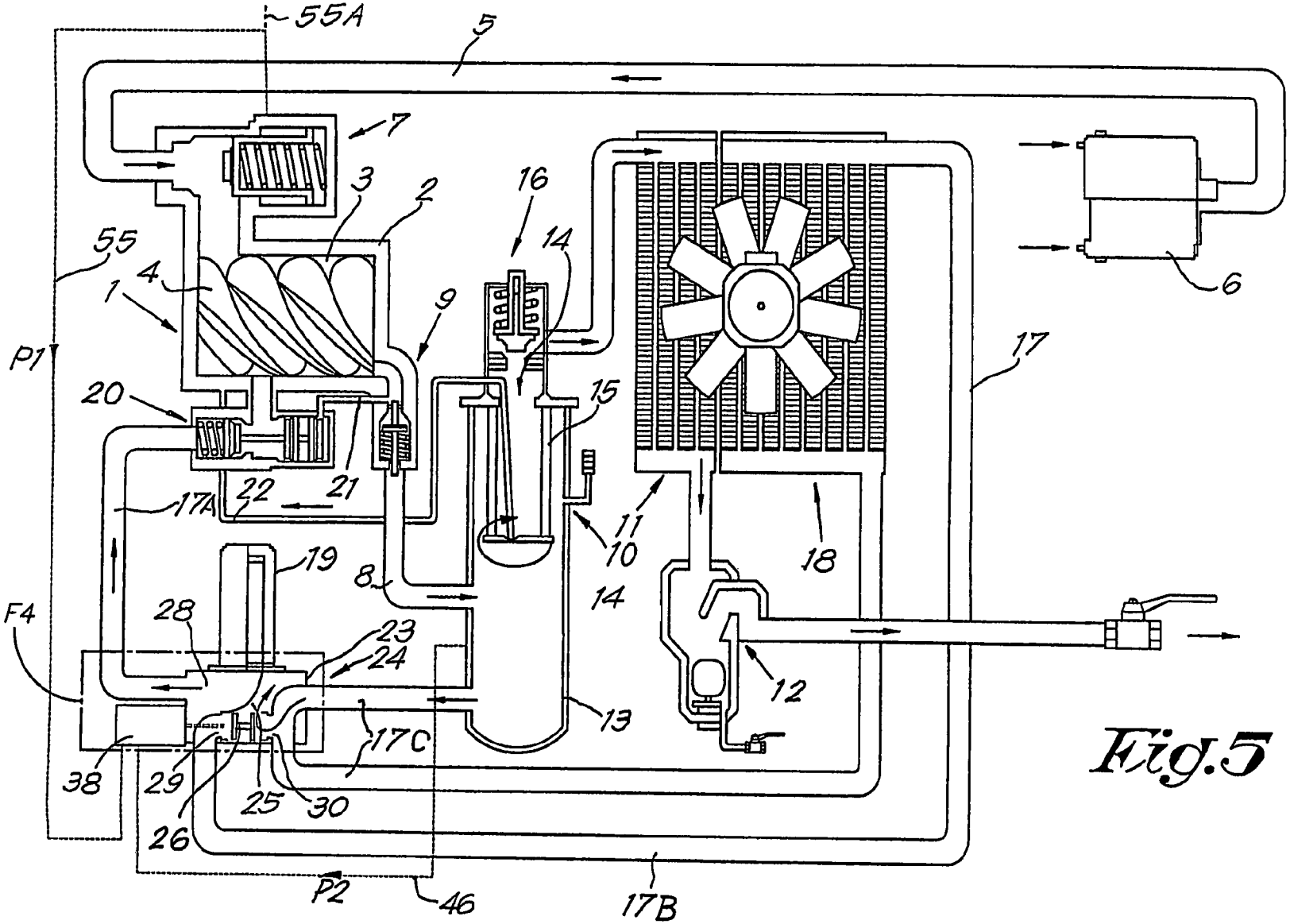
Figure 6:
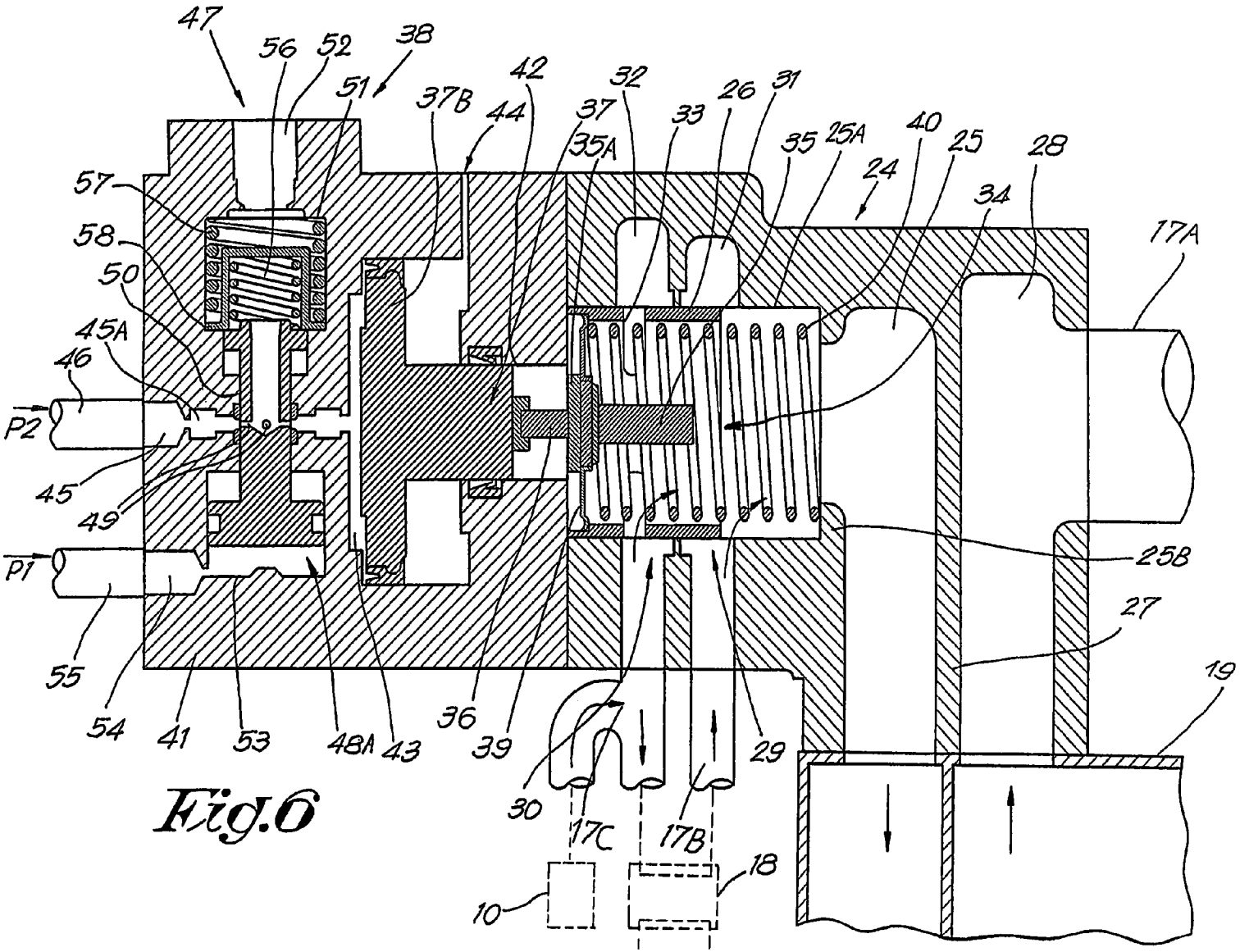
Figure 7:
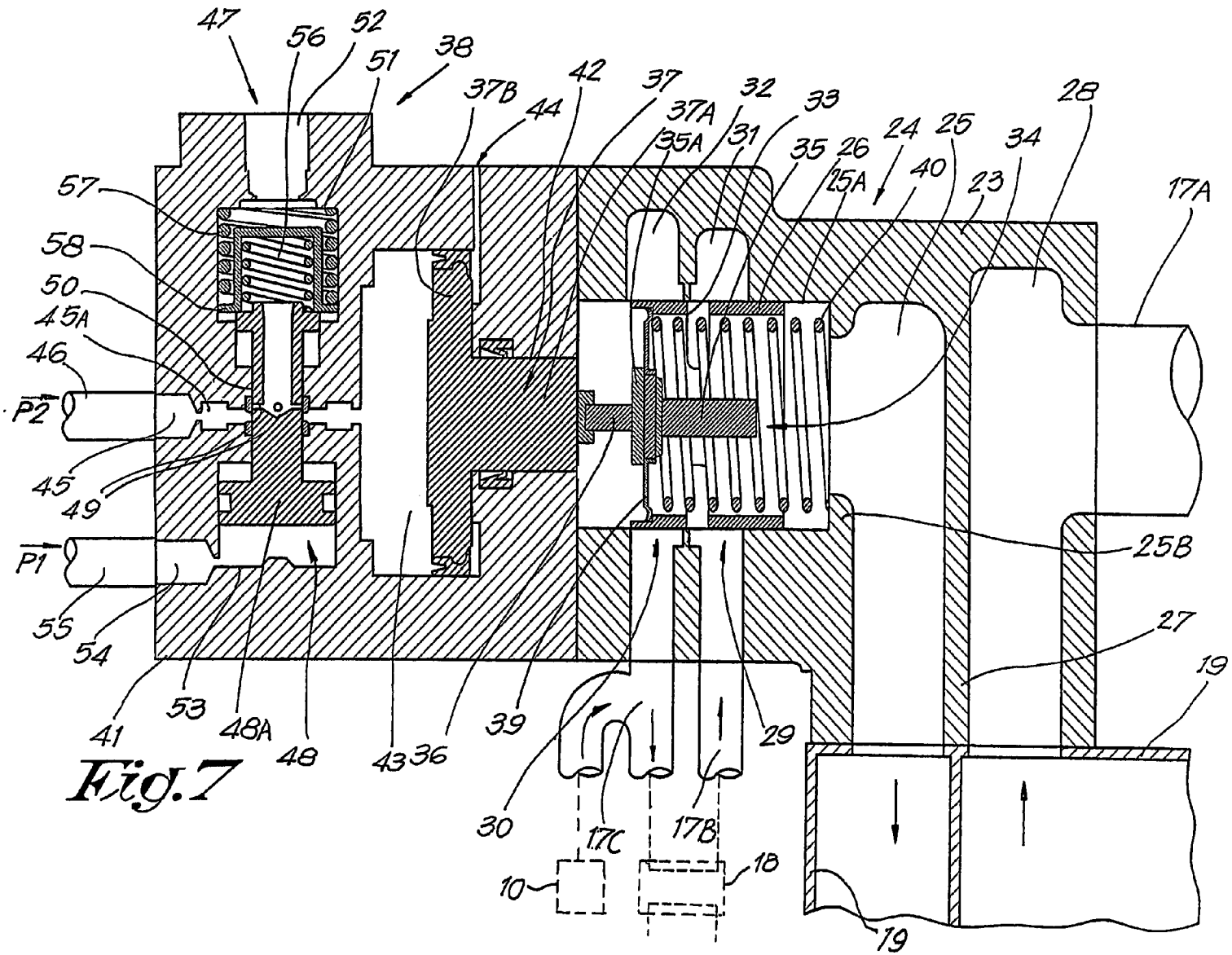

With the intention of better showing the characteristics of the invention, hereafter, as an example without any limitative character, a preferred form of embodiment of a method for controlling the oil recirculation in an oil-injected screw-type compressor and screw-type compressor controlled in this manner, according to the invention, is described, with reference to the accompanying drawings, wherein:

FIG. 1 schematically represents a screw-type compressor according to the invention, during cold starting;

FIG. 2, in cross-section and at a larger scale, represents a practical embodiment of the part indicated by F2 in FIG. 1;

FIG. 3 represents the screw-type compressor of FIG. 1, however, during the normal regime operation, either loaded or unloaded, when the oil is warm;

FIG. 4, in cross-section and at a larger scale, represents a practical embodiment analogous to that from FIG. 2, of the part indicated by F4 in FIG. 3;

FIG. 5 represents the screw-type compressor during the transition from unloaded to loaded operation, when the oil still is warm;

FIG. 6, in cross-section and at a larger scale, represents a practical embodiment analogous to that of FIGS. 2 and 4, of the part indicated by F6 in FIG. 5;

FIG. 7 represents a cross-section analogous to that from FIGS. 2, 4 and 6, however, relating to another status of the screw-type compressor.

The screw-type compressor represented in the figures comprises a compressor element 1 comprising a housing 2 surrounding a rotor chamber 3 in which two mutually cooperating screw-shaped rotors 4 are installed. The compressor element 1 is driven by a motor, not represented in the figures.

At the inlet side, an inlet conduit 5 gives out in the rotor chamber 3, in which conduit 5 air filters 6 and a controlled inlet valve 7 are provided, whereas at the outlet side, a pressure conduit 8, by means of an outlet valve 9 which, for example, is a return valve, connects to the rotor chamber 3.

In the pressure conduit 8, successively an oil separator 10, an air cooler 11, and a water separator 12 are arranged.

In the oil separator 10, there is a vessel 13 which is provided with an outlet 14 at the top. Opposite to outlet 14, a filter 15 is installed in the vessel 13, and a minimum pressure valve 16 is installed in the outlet 14.

The major part of the oil is collected in the lower part of the vessel 13, and the underside of vessel 13 is connected to an injection point of the compressor element 1 by means of a recirculation conduit 17.

In this recirculation conduit 17 for the oil, successively an oil cooler 18, an oil filter 19 and a controlled oil valve 20 are provided.

For control, the oil valve 20, by means of a control conduit 21, is in connection with the outlet of the compressor element 1.

By means of a conduit 22, the interior of the filter 15 is in connection with the interior of the rotor chamber 3 for recirculating the oil collected at the bottom of the filter 15.

The oil cooler 18 and the air cooler 11 are cooled by a common fan and have radiators which are united to one single block.

The oil filter 19 is provided on the housing 23 of a thermostatic valve 24. This valve 24 comprises a space 25 in which a valve element 26 is situated and a space 28 separated therefrom by a partition 27.

The space 25 is in connection with the inlet of an oil filter 19 placed on the housing 23 and thus is situated in the recirculation conduit 17. This space 25 forms the connection between said oil filter 19 and the part 17B of the recirculation conduit 17 situated between the outlet of the oil cooler 18 and the housing 23. The connection of the part 17B to the space 25 forms a passage 29 which can be closed off by the valve element 26.

A bypass having the form of a passage 30 from the part 17C of the recirculation conduit 17, situated between the oil separator 10 and the inlet of the oil cooler 18, to the space 25 gives out into the space 25. This passage 30, too, can be closed off by the valve element 26.

The bypass for the oil bridges-over the oil cooler 18, and through this bypass or passage 30, oil can flow directly from the oil separator 10 to the oil filter 19 and further to the compressor element 1 without passing through oil cooler 18.

When the valve element 26 closes off the passage 30 and thus the bypass, it opens the passage 29, and reverse, when the valve element 26 opens the passage 30, it closes off the passage 29. In an intermediate position, the valve element 26 leaves open both passages 29 and 30.

The space 28 is in connection with, on one hand, the outlet of the filter element of the oil filter 19 and, on the other hand, the part 17A of the recirculation conduit 17 situated between the oil filter 19 and the oil valve 20.

As is represented more detailed in FIGS. 2, 4, 6 and 7, the thermostatic valve 24 can be composed as follows:

The valve element 26 is a bush which is axially movable in a bore 25A which forms part of the space 25 and into which ring-shaped chambers 31 and 32 give out, which respectively form part of the passages 29 and 30 to which the conduit parts 17B and 17C connect.

The valve element 26 is provided with a slot 33 extending over a part of the circumference parallel to the chambers 31 and 32 and being smaller than the width of the chambers 31 and 32 in axial direction.

A temperature-sensitive element 34 is axially installed in the valve element 26, said element 34 having a base 35 and a finger 36 moving out of it when the temperature increases.

Normally, the finger 36 cooperates with a stop which is movable and which, in the represented example, is formed by a piston 37 which is situated in the prolongation of the bore 25A.

This piston 37 forms part of a control system 38 which shall be described in the following.

The base 35 is attached to the valve element 26 by the intermediary of a disk ring 39.

A spring 40, which is provided between said disk ring 39 and a collar 25B of the wall of the bore 25A, pushes the valve element 26 into the direction of the housing 41 of the control system 38.

Said piston 37 consists of a plunger 37A fitting into an opening 42 in the housing 41, and a head 37B with larger diameter situated in a chamber 43 in the housing 41.

At the plunger side of the head 37B, the chamber 43, by means of a duct 44, is in connection with the atmosphere.

At the other side of the head 37B, the chamber 43, by means of a duct 45, connects to a conduit 46 ending up in the vessel 13.

This duct 45 can be put into connection with the atmosphere by means of an auxiliary control, formed by a relief valve 47. Said relief valve 47 comprises a valve body 48 having a hollow part provided with radial openings 49 in its wall, which, for one position of this valve body 48, connects the duct 45, through the interior of this last-mentioned valve body 48, to the atmosphere.

A part of the duct 45 forms a ring-shaped duct 45A around the bore 50 for this valve body 48, and for said position of the valve body 48, the openings 49 give out onto this ring-shaped duct 45A.

Whereas the interior of the valve body 48 at one extremity, by means of a chamber 51 and a duct 52 in the housing 41, is in connection with the atmosphere, the hollow valve body 48 is closed off at the other extremity and has a piston-forming part 48A which is movable in a cylinder-forming chamber 53.

The most outwardly situated extremity of this chamber 53 connects, by means of a duct 54, to a control conduit 55 which is in connection with the control conduit 55A for supplying the control pressure P1 to the inlet valve 7. By means of a not represented duct, the other extremity of the chamber 53 is in connection with the atmosphere.

In the chamber 51, two springs 56 and 57 are arranged which counteract the movement of the valve body 48 under the influence of this control pressure P1, to wit a relatively weak spring 56 between this valve body 48 and the end of a tubular element 58, and a stronger spring 47 which is provided around the tubular element 58 between a collar of the tubular element 58 and the extremity of the chamber 51.

The control of the recirculation of oil from the vessel 13 to the compressor element 1 takes place as follows:

When the screw-type compressor is at rest, the inlet valve 7 is closed and there is no control pressure P1. The part 48A of the valve body 48 is situated against the extremity of the chamber 53, and the openings 49 are closed off by the housing 41.

The pressure P2 in the oil separator 10 is situated minimum 0,6 bar above atmospheric pressure, such that the piston 37 is pushed into withdrawn position, whereby its end surface forming a stop for the finger 36 is situated in the plane of the end of the bore 25A, as represented in FIGS. 2 and 4.

When the oil flowing from the oil separator 10 back to the compressor element 1 has a temperature which is lower than a well-defined value, as, for example, with a first start before the compressor is put under load, then the finger 36 is slid maximally into the base 35, this is until the widened extremity of the finger 36 is situated against the base 35, as represented in FIG. 2. Hereby, the valve element 26 is in the position in which the passage 29 is closed off and the passage 30 is open.

The oil flows from the oil separator 10, through the passage 30 and thus without being cooled in the oil cooler 18, to the compressor element 1, as represented by arrows in FIGS. 1 and 2.

When the temperature of the oil increases, then the temperature-sensitive element 34 becomes longer and the finger 36 is pushed out of the base 35, which means that, considered that the piston 37 does not change its position by the pressure P1, the base 35 is moved away from the piston 37. By means of the disk ring 39, the base 36 takes along the valve element 26, against the effect of spring 40. At a well-defined moment, this valve element 26 will leave open both passages 29 and 30.

Once the oil has reached its normal operation temperature, then the finger 36 is slid out maximally, and the condition represented in FIGS. 3 and 4 is obtained. The valve element 26 closes off the passage 30 entirely, whereas the passage 29 is maximally open. All of the oil flows back through oil cooler 18, as represented by arrows in FIGS. 3 and 4.

At the moment that the control of the compressor gives a signal for the transition from unloaded to loaded condition, in other words, when compressed air has to be delivered, the pressure P2 prevailing in the oil separator 10, by means of control conduit 55A, is immediately used as control pressure P1 of the inlet valve 7. In the chamber 53, thus a control pressure P1 prevails which is equal to the pressure P2 in the oil separator 10. This control pressure P1 is sufficiently high in order to move the valve body 48 against the force of the weakest spring 56, however, is insufficient in order to equally compress the stronger spring 57. Thereby, the valve body 48 takes a position as represented in FIG. 6, whereby the openings 49 give out onto the duct 45.

Consequently, the chamber-43 temporarily is in connection with the atmosphere and the piston 37 in fact is free, and the temperature-sensitive element 34 can push the piston 37 away. Under the influence of the spring 40, the valve element 26, as represented in FIG. 6, will be pushed against the end of bore 25A, whereby the passage 29 as well as the passage 30 are open and the oil thus can flow through the oil cooler 18 as well as through the bypass or passage 30. At that moment, the inlet valve 7 still is closed.

From FIG. 6, it is obvious that the valve element 26 takes said position regardless whether the oil is cold or warm. When the temperature-sensitive element 34, as a result of the warm oil, has a maximum length, it simply pushes the piston 37 further into the chamber 43, as represented in FIG. 6.

The pressure P2 in the oil separator 10 increases continuously until it is high enough to open the inlet valve 7. At this stage, the risk is the largest that temperature peaks occur in the compressor element 1 because of insufficient oil lubrication as a result of too low an oil pressure P2. Due to the fact that the oil, as represented by arrows in FIG. 6, can flow through the passage 30 and the chamber 25 directly to the compressor element 1, the pressure drop in the oil cooler 18 is avoided, as a result of which a higher pressure is obtained at the inlet of the oil valve 20 and whereby thus a better oil lubrication is obtained during said transition stage from unloaded to loaded operation of the screw-type compressor.

After opening the inlet valve 7, the pressure P2 in the oil separator 10 and thus also the control pressure P2 increases more rapidly. When the control pressure P1 is sufficiently high, the valve body 48, against the effect of the stronger spring 57, is moved further up into the position represented in FIG. 7. The passages 49 then are closed off by the housing 41.

The part of the chamber 43 onto which the duct 45 gives out, then no longer is in connection with the atmosphere, but is at the pressure P2.

Thereby, the piston 37 is pushed into its position represented in FIG. 7, whereby the plunger 37A fills the opening 42 and forms a stop in the plane of the end of the bore 25A.

The pressure of the oil in the chamber 25, however, also is approximately equal to P2, however, this pressure is exerted onto a smaller surface, to wit that of the plunger 37A, than the surface of the head 37B.

As the oil is at operation temperature, the finger 36 of the temperature-sensitive element 34 is maximally pushed out, as a result of which the valve element 26, against the effect of the spring 40, is brought into the position represented in FIG. 7.

This valve element 26 then closes off the passage 30, whereas the passage 29 is open. The oil flows as is represented by arrows in FIGS. 3 and 7, this is through the part 17C of the conduit 17 to the oil cooler 18 and from there through the part 17B and through the passage 29 to the filter 29.

When the load of the compressor, which by now is warmed up, stops, then first the inlet valve 7 is closed and the control pressure P1 drops below said minimum value, as a result of which the valve body 48, by the springs 56 and 57, is pushed back to the position represented in FIGS. 3 and 4.

The pressure P2 in the oil separator and thus also the pressure of the oil effecting on the piston 37, drops to a minimum value, which nevertheless still is sufficient for keeping the piston 37 pushed in, such that the condition from FIG. 4 is obtained and the warm oil, as represented in FIG. 3, must flow through oil cooler 18.

When the compressor again changes from the unloaded to the loaded condition, the process described heretofore in connection with such transition is repeated.

Thus, this means that with each transition from the unloaded to the loaded condition of the compressor, when the oil pressure is low, the passage 30, as represented in FIG. 6, is temporarily opened and thus the oil substantially can flow through the bypass formed by this passage 30 directly from the oil separator 10 to the filter 19 and from there to the oil valve 20, whereby an additional pressure drop over the oil cooler 18 is avoided.

In that during the transition, as also represented in FIG. 6, passage 29 is open, too, the oil also will partially, however, to a lesser extent, flow through the oil cooler 18, as a result of which, at the end of said transition phase, when the passage 30 suddenly is closed off and the maximum oil flow rate must flow through the oil cooler 18, the oil flow rate through this oil cooler 18 will increase less sudden and the transition thus will take place at a steadier pace.

As with each transition from an unloaded to a loaded condition, each time the oil cooler 18 is bypassed, the pressure drop in the oil is smaller, as a result of which the oil is injected into the compressor element 1 at a higher pressure and consequently a better lubrication is obtained, such that the risk of temperature peaks at the outlet of the compressor element 1 diminishes.

According to the same argumentation, it can be stated that during unloaded operation, the oil pressure in the oil separator 10 may drop lower than in a classical compressor without control system 38 according to the invention, without the risk of such damaging temperature peaks.

The invention is in no way limited to the form of embodiment described in the aforegoing and represented in the accompanying drawings, however, such method for controlling the oil recirculation in an oil-injected screw-type compressor and such controlled screw-type compressor can be realized in various variants, without leaving the scope of the invention, as determined by the accompanying claims.

The invention claimed is:

1. Method for controlling the oil recirculation in an oil-injected screw-type compressor comprising a compressor element (1), connected thereto an inlet conduit (5) and a pressure conduit (8), an oil separator (10) in said pressure conduit (8), an oil recirculation conduit (17) between said oil separator (10) and the compressor element (1), in which recirculation conduit (17) an oil cooler (18) is installed, and a passage or bypass (30) bridging-over the oil cooler (18) in the recirculation conduit (17), which controlling is performed by means of a thermostatic valve (24) having a valve element (26) which can be moved by means of a temperature-sensitive element (34), whereby the temperature-sensitive element (34) measures the temperature of the recirculating oil and the valve element (26), if this temperature is below a certain value, opens the bypass (30), such that the separated oil from the oil separator (10) can flow directly towards the compressor element (1) without having to flow over the oil cooler (18) and, if the temperature of the oil is above a certain value, which is higher than or equal to the aforementioned value, the valve element (26) closes off the bypass (30), characterized in that during the transition of the screw compressor from the unloaded to the loaded condition, the effect of the temperature-sensitive element (34) temporarily is switched off at least partially, such that the valve element (26) temporarily takes a position in which, regardless of the temperature of the oil, at least the bypass (30) is open and thus the recirculation of oil from the oil separator (10) to the compressor element (1) temporarily takes place at least through this bypass (30).

2. Method according to claim 1, characterized in that during the transition from unloaded to loaded, the valve element (26) temporarily takes a position whereby the bypass (30) as well as the recirculation conduit (17) are open, such that the oil temporarily can flow through the bypass (30) as well as through the oil cooler (18) back to the compressor element (1), regardless of the temperature of the oil.

3. Method according to claim 1, characterized in that the temporarily switching off of the effect of the temperature-sensitive element (34) takes place by realizing a part of the wall of the thermostatic valve (24), against which the temperature-sensitive element (34) normally is situated, as a piston (37) of a pneumatically controllable piston mechanism.

4. Method according to claim 1, characterized in that as control pressures, the pressure (P2) in the oil separator (10) and the control pressure (P1) for operating a controlled inlet drive (7) in the inlet conduit (5) are used.

5. Method according to claim 1, characterized in that the pressure (P2) prevailing in the oil separator (10) is exerted onto a head (37B) of the piston (37), whereas the oil pressure itself is exerted onto an end of the piston (37) with a smaller surface, said end forming a plunger (37A), and the side along which the first-mentioned pressure (P2) is exerted, can be put into connection with the atmosphere by means of an outlet (52) which is controlled by a valve body (48) which in its turn is controlled by the control pressure (P1) of a controlled inlet valve (7).

6. Oil-injected screw-type compressor comprising a screw-type compressor element (1), connected thereto an inlet conduit (5) and a pressure conduit (8), an oil separator (10) in said pressure conduit (8), an oil recirculation conduit (17) between said oil separator (10) and the compressor element (1), in which recirculation conduit (17) an oil cooler (18) is installed, and a bypass (30) bridging-over the oil cooler (18) in the recirculation conduit (17) and which can be closed off by the valve element (26) of a thermostatic valve (24) with a valve element (26) which can be moved by means of a temperature-sensitive element (34) situated in the oil recirculation conduit (17), characterized in that the screw-type compressor comprises a control system (38) which, during the transition from the unloaded to the loaded condition, temporarily switches off the effect of the temperature-sensitive element (34) onto the valve element (26) of the thermostatic valve (24) at least partially, such that during this transition, the valve element (26) is in a position in which at least the bypass (30) is open, regardless of the temperature of the oil.

7. Screw-type compressor according to claim 6, characterized in that the bypass (30) is limited to a passage (30) between a part (17C) of the recirculation conduit (17) situated between the oil separator (10) and the oil cooler (18), and a part (17B) of the recirculation conduit (17) situated between the oil cooler (18) and the compressor element (1).

8. Screw-type compressor according to claim 6, characterized in that the valve element (26) of the thermostatic valve (24) is situated in the bypass (30) as well as in the recirculation conduit (17) upstream from the bypass (30), such that, in one position, it simultaneously opens the bypass (30) and closes off the part (17B) of the recirculation conduit (17) situated between the outlet of the oil cooler (18) and the bypass (30), and in another position simultaneously closes off the bypass (30) and opens said part (17B) of the recirculation conduit (17).

9. Screw-type compressor according to claim 8, characterized in that the valve element (26) in the first-mentioned position and/or in an intermediary position opens the bypass (30) as well as said part (17B) of the recirculation conduit (17).

10. Screw-type compressor according to claim 7, characterized in that the thermostatic valve (24) comprises a housing (23) with a space (25) inside, in which space a valve element (26) is movable, and that the passage (30) is an opening giving out onto this space (25).

11. Screw-type compressor according to claim 10, characterized in that it comprises an oil filter (19) which is installed in the recirculation conduit (17), between the bypass (30) and the compressor element (1), and the space (25) is in connection with the inlet of the oil filter (19).

12. Screw-type compressor according to claim 6, characterized in that the control system (38) comprises a piston (37) which is movable in a chamber (43) and in one position forms a stop for a temperature-sensitive element (34) of the thermostatic valve (24).

13. Screw-type compressor according to claim 12, characterized in that the chamber (43), at one side of the piston (37), is in connection with the oil separator (10), such that the piston (37) can be maintained in said position by the pressure (P2) in this oil separator (10), and the control system (38) comprises an auxiliary control in the form of a relief valve (47) putting the chamber (43) at said side in connection with the atmosphere when a control pressure (P1) is situated between two well-defined values.

14. Screw-type compressor according to claim 9, characterized in that the relief valve (47) is controlled by the control pressure (P1) of the inlet valve (7).

15. Screw-type compressor according to claim 13, characterized in that the relief valve (47) comprises a valve body (48) with a hollow part giving out to the atmosphere and which in its wall is provided with at least one opening (49) which, for a certain position of the valve body (48), gives out onto a duct (45) by which the chamber (43) is in connection with the oil separator (10).

16. Screw-type compressor according to claim 14, characterized in that at one extremity, the valve body (48) has a piston-forming part (48A) which is movable in a chamber (53) which is in connection with a part of the compressor where the control pressure (P1) for opening the inlet valve (7) is prevailing.

17. Screw-type compressor according to claim 16, characterized in that the other extremity of the valve body (48) cooperates with two springs (56, 57), whereby the one (57) thereof is stronger than the other and only can be compressed by the valve body (48) after the other (56) has been partially compressed.

* * * * *